United States Patent [19]

Wolter

[11] Patent Number: 4,562,712

[45] Date of Patent: Jan. 7, 1986

[54] KEY

[76] Inventor: Heinz Wolter, Meiswinkel 3, 5067 Kürten, Fed. Rep. of Germany

[21] Appl. No.: 576,997

[22] Filed: Feb. 6, 1984

[30] Foreign Application Priority Data

Feb. 19, 1983 [DE] Fed. Rep. of Germany ..... 3305822
Jan. 20, 1984 [EP] European Pat. Off. ..... 84100621.6

[51] Int. Cl.[4] ..... A47G 29/10

[52] U.S. Cl. ..... 70/456 R; 70/408; 70/395

[58] Field of Search ..... 70/395, 408, 456 R; 362/116

[56] References Cited

U.S. PATENT DOCUMENTS 3,310,668 3/1967 Schwartz ..... 240/6.4
3,313,135 4/1967 Reisner ..... 70/408
3,349,589 10/1967 Fricke ..... 70/395
3,797,291 3/1974 Sigmorghi ..... 70/395
4,303,966 12/1981 Wolter ..... 362/116
4,392,186 7/1983 Cziment ..... 362/116

FOREIGN PATENT DOCUMENTS 7838288 3/1979 Fed. Rep. of Germany .

*Primary Examiner*—Robert L. Wolfe
*Attorney, Agent, or Firm*—Martin A. Farber

[57] ABSTRACT

A key with key bit and separate handle, the end of the key bit extending form-lockingly into a channel in the handle, the channel being directed towards a narrow side of the handle. A disengageable insertion detent is provided for locking a bit to the handle, wherein a construction is provided which is simple to manufacture, advantageous for assembly and stable in use.

19 Claims, 18 Drawing Figures

KEY

BACKGROUND OF THE INVENTION

The present invention relates to a key with key bit (key shaft) and a handle, the end of the key bit extending in form-locked manner into a channel which is directed towards a narrow side of the handle.

Such keys are known on the market. The connection between the handle and the end of the key bit is produced therein by injection molding of the key bit. The attachment of the handle to the bit therefore always requires a special apparatus.

The object of the present invention is to develop a key of the afore-mentioned type in a manner which is simple to manufacture so that a good assembly and assembling of key bit and handle can be effected without expensive apparatus.

SUMMARY OF THE INVENTION

This object is achieved by a forked-shaped insertion connection and/or a special releasable insertion detent locking between the bit and handle.

As a result of this development, there is created a key of the above type, the key bit of which can be combined in simple fashion with the handle. The assembling of handle and key bit does not require any special tools. It is done merely by way of the insertion detent locking. It is possible to coordinate differently shaped key bits with the same handle. This results in advantages in stocking and shipment.

One advantageous further development resides in the fact that the place of the detent locking is on the narrow edge of the key bit. In this way, a large form-interlocking surface can be obtained with little reduction in rigidity.

Interchangeability of the key bit can be obtained in the manner that the detent locking is formed by a mandrel which can be displaced against spring action in a direction transverse to the handle and which has an actuation surface which is exposed at the wide side of the handle, with a portion of the periphery of the mandrel entering in form-locked manner into a recess extending in the narrow side of the key bit. For the purpose of the insertion of the key bit, the actuating surface must be pressed or struck. The mandrel moves out of the region of the channel and permits the insertion of the key bit. As soon as the recess in the key bit is aligned with the mandrel, the latter can enter into the locking position as a result of spring action. The pulling out of the key bit must be effected intentionally, namely after prior displacement of the mandrel.

In order to prevent any undesired displacement of the mandrel, the actuation surface which is countersunk and is smaller in cross section than the cross-sectional area of the mandrel within the region of the form-interlocking.

One advantageous embodiment is that the detent locking is formed by a slide bolt which is displaceable obliquely to the channel under spring action and which enters in form-interlocking manner into a recess in the narrow side of the key bit. This structural shape permits a relatively large path of displacement of the bolt with a long compression spring. For purposes of insertion, the bolt need merely be displaced in such a manner that it frees the cross section of the channel. It is advantageous for the recess to be developed as an angular recess. Large forces acting on the key bit can therefore be taken up without damage. Therefore, the key bit cannot be pulled out unintentionally. So that the assembling of the handle and the key bit can be effected without tools, the end surface of the bolt extends at an acute angle to the direction of insertion of the bit. Upon introduction of the key bit, its end surface strikes, within the corresponding region, against the end surface of the bolt, thereby leading to a trap-like deflecting movement of the bolt, which moves forward rapidly when the recess in the key bit lies in the path of the bolt. In order to obtain a good surface of engagement for pushing the bolt back, the end surface of the bolt is formed in V shape.

Simple displacement of the bolt can be obtained by a tool-insertion opening which opens in front of the end of the bolt is alongside the channel. A pin-shaped tool can be passed through said opening and can displace the bolt against the spring biasing on the bolt. The angling is so selected that the trap-like deflection movement of the bolt is not impaired.

In one embodiment the detent locking can be provided by a cylindrical formation of the peripheral surface of the mandrel which engages the recess in the key bit in form-locked fashion.

In another embodiment, there can be employed a development such that the peripheral surface of the bolt which engages the recess in the key bit in form-locking manner is formed by an angular section (E) of the mandrel (21').

In one embodiment, insertion attachment which is particularly stable in use can be simply obtained in the manner that the bit is developed in fork-shape at its insertion end and a rib on the flashlight housing enters in form-locking manner into the opening in the fork. Support is thus effected on two additional narrow-edge sections and therefore on a total of four edges.

Due to the fact that, furthermore, the insertion region for the forked bit is covered in the manner of a sleeve by the edge of the cap, a relatively large accumulation of material is available for the insertion region. Furthermore, the cap can be made with a thin wall and thus in a shape which is favorable for a clip-on attachment. In order, despite the fork-shaped development of the insertion end of the bit, to assure fool-proof assembling with respect to the correct position with regard to the place of the detent locking, the one fork tine of the forked bit which has the recess has a different and, in particular, larger width than the other fork tine.

Four embodiments of the invention will be explained by example below with reference to FIGS. 1 to 18 of the drawings.

DETAILED DESCRIPTION OF THE PREFERRED EMBODIMENTS

Figure 2:
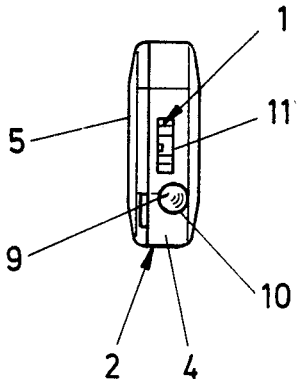
FIG. 2 is a side view of FIG. 1.
Figure 1:
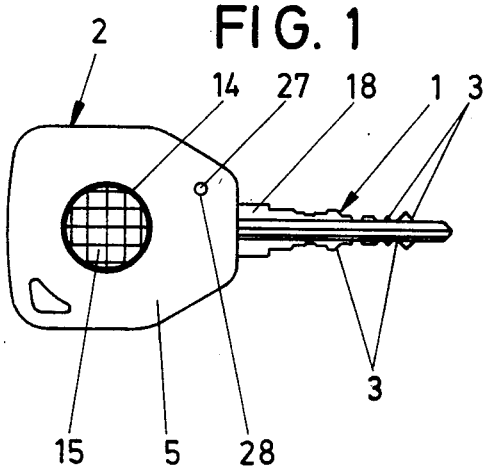
FIG. 1 is a view of the key according to the first embodiment, the handle being developed as a flashlight.
Figure 3:
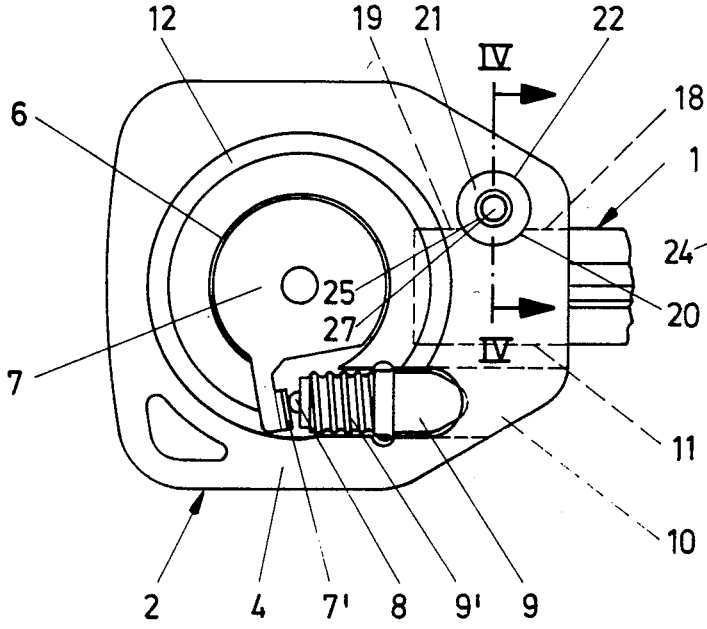
FIG. 3 is, on a large scale, a view of the key with the cap of the handle removed.
Figure 4:
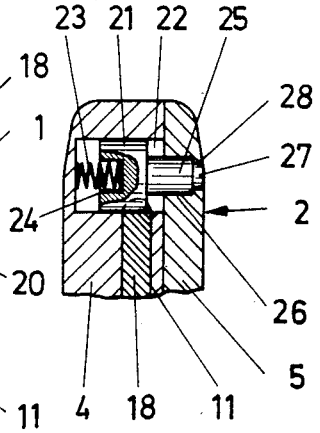
FIG. 4 is a section along the line IV—IV of FIG. 3.
Figure 5:
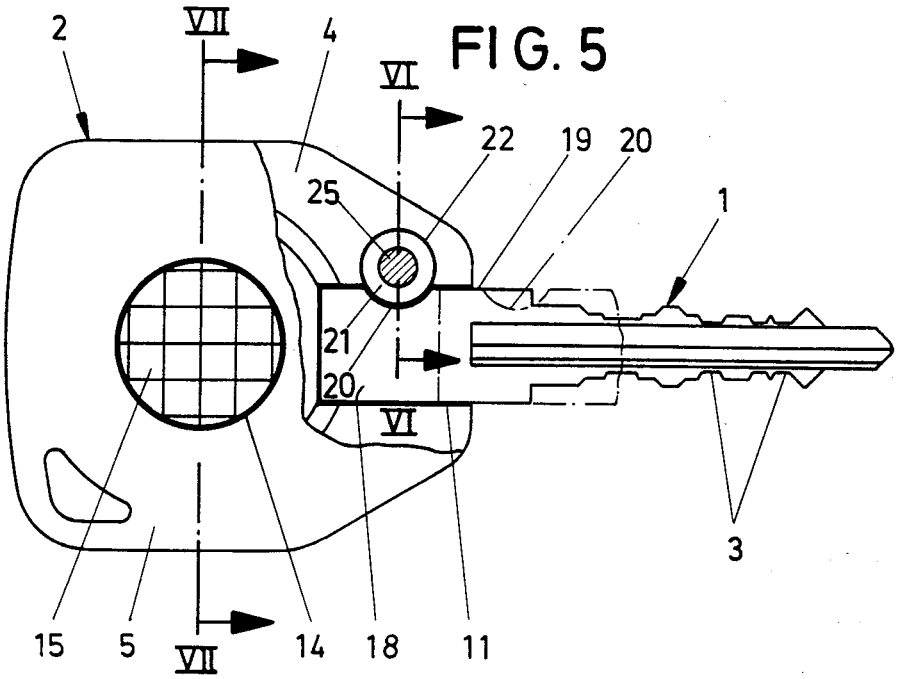
FIG. 5 is a showing corresponding to FIG. 3, in which the mandrel has been displaced to produce the detent locking, with the release of the key bit.
Figure 7:
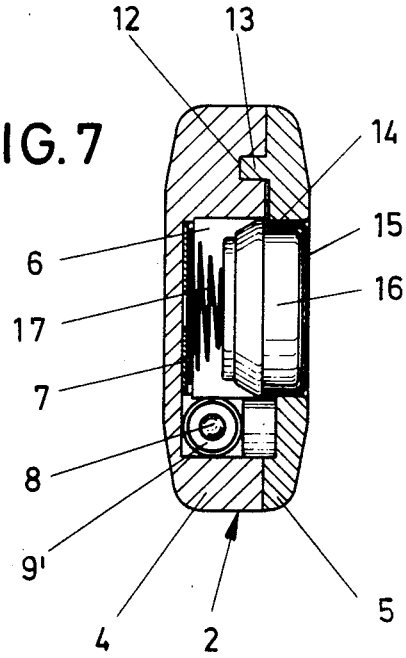
FIG. 7 is a section along the line VII—VII of FIG. 5.

The key of the first embodiment, a shown in FIGS. 1 to 7, consists of the key bit 1 and handle 2. The key bit is provided on its narrow edges with a number of wards 3 which serve for acting on the the tumblers of a lock cylinder, not shown.

The handle 2 is developed as a flashlight. For this purpose, the handle consists of a flashlight housing 4 and a cap 5 which closes off the housing, which are assembled in such manner that the flashlight housing 4—shown in the direction transverse to the key bit 1—is thicker than the cap 5. The wide surface of the flashlight housing 4 which faces the cap 5, defines a cup-shaped recess 6. On the bottom of the latter, there is a contact plate 7 from which a contact lug 7′ depends which acts on the end contact stud 8 of an incandescent bulb 9. The bulb is located behind an opening 10 which is parallel to the a channel 11 which receives the key bit 1.

Concentric to the recess 6, there is an annular groove 12 which extends from the wide surface of the flashlight housing and into which an annular rib 13 extending from the cap 5 engages in a force-fit manner, thus holding the cap 5 on the flashlight housing 4. The cap 5 has an opening 14 through it for an actuating button 15. The button 15 partially surrounds a round battery 16. A conical spring 17 acts against the bottom of the battery. The other end of the spring rests against the contact plate 7. Upon actuation of the button 15, the battery 16 is displaced such that the circumferential surface of the battery makes contact with the wall of the base 9′ of the bulb 9, thus causing the bulb to light up. When the actuating button 15 is released, the conical spring 17 moves the battery 16 back into its starting position together with the actuating button 15.

The channel 11 extends through and past the annular groove 12 and is adapted to correspond to the cross section of the end 18 of the key bit 1. A rounded recess 20 is present on a narrow edge 19 of the end 18 of the key bit. The rounding is adapted to correspond to the circumferential surface of a mandrel 21 which is displaceable in the direction transverse to the handle 2. The mandrel is guided in a cup-shaped transverse bore 22 in the flashlight housing 4 and is acted on by a compression spring 23 which rests against the bottom of the transverse bore 22 and extends in part into a blind hole 24 in the mandrel 21. The mandrel 21 is continued by a section 25 of smaller cross section which is guided within a bore 26 in the cap 5. This section 25 is reduced to a stepped-down actuating surface 27 of smaller cross section, for which the cap 5 has a complementary opening 28. With the key bit 1 inserted in the channel 11, the mandrel 21 engages in form-locked or complementary manner into the recess 20 and prevents withdrawal of the key bit 1. In this position, the actuating surface 27 of the mandrel does not extend beyond the outer surface of the cap—see FIG. 4—so that accidental or unintended displacement of the mandrel cannot take place.

Figure 6:
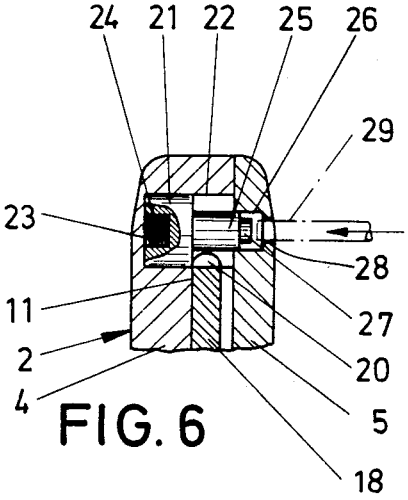
FIG. 6 is a section along the line VI—VI of FIG. 5.
Figure 9:
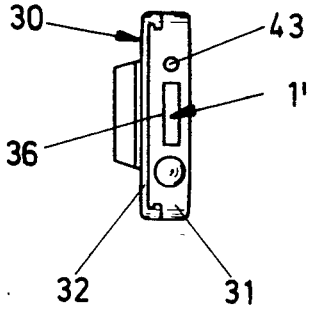
FIG. 9 is a side view of the embodiment of FIG. 8.
Figure 8:
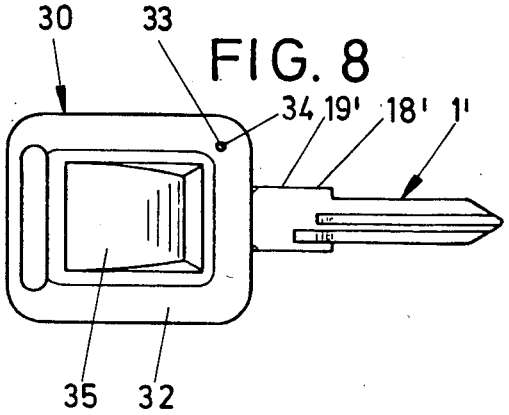
FIG. 8 shows the second embodiment of the key.

The insertion or removal of the key bit 1 requires displacement of the mandrel 21 against the load of spring 23. For this purpose—as shown in FIG. 6—the actuating surface 27 must be pressed by a tool 29, the mandrel 21 thereby coming out of engagement with the recess 20 in the end 18 of the key bit. It can also be noted from FIG. 6, that the section 25 of smaller cross section of the mandrel 21 does not then extend into the recess 20. The key bit 1 can thus be removed, as shown in dash-dot line in FIG. 5. A new key bit can then be inserted in the channel 11 which has thus been freed, in which case the mandrel 21 is also brought into the diverted position so as to free the entire cross section of the channel.

In accordance with the second embodiment, shown in FIGS. 8–13, the key handle 30 is also formed of a flashlight housing 31 and a cap 32. The cap is guided by ledges on the flashlight housing 31. A lock pin 33, which is arranged within the flashlight housing 31 and faces the cap 32, engages under spring load into an opening 34 in the cap 32 and secures the cap in position. The cap can be removed only after the lock pin 33 has been displaced. The cap 32 bears the actuating button 35 by which the bulb 9 can be caused to light up.

The flashlight housing 31 forms a channel 36 which channel opens towards a narrow side of the housing. This channel is adapted to the cross section of the end 18′ of the key bit 1′. From the narrow side 19′ of the end 18′ of the key bit. An angular recess 37 extends in such a manner that the arm 37′ of the recess, which arm 37′ is closer to the tip of the key, forms an angle alpha with respect to the longitudinal direction of the key bit, this angle alpha being about twice as large as an angle beta formed between another arm 37″ of the recess and the longitudinal direction of the key bit. In the embodiment shown, the angle alpha is about 60° while the angle beta is 30°.

Figure 10:
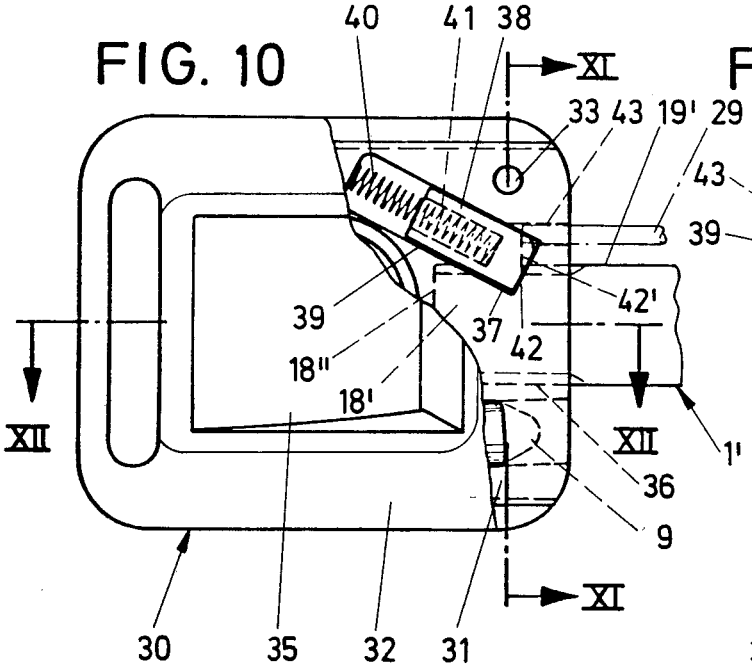
FIG. 10 is a view, partially in elevation and partially broken away, of the key with the bolt in the engaged position.
Figure 11:
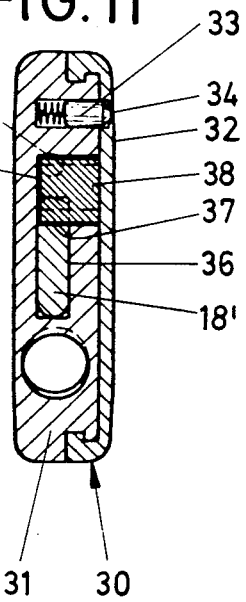
FIG. 11 is a section along the line XI—XI of FIG. 10.
Figure 12:
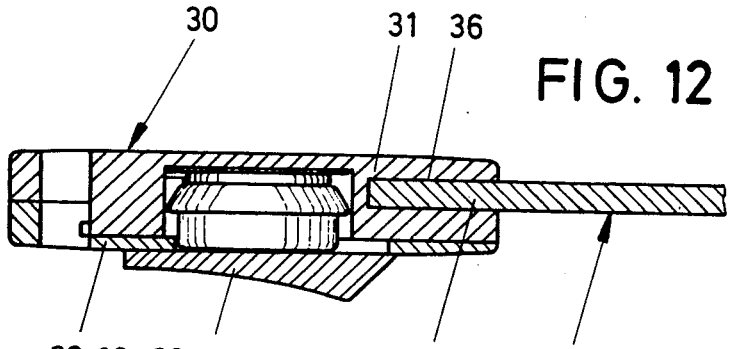
FIG. 12 is a section along the line XII—XII of FIG. 10.
Figure 13:
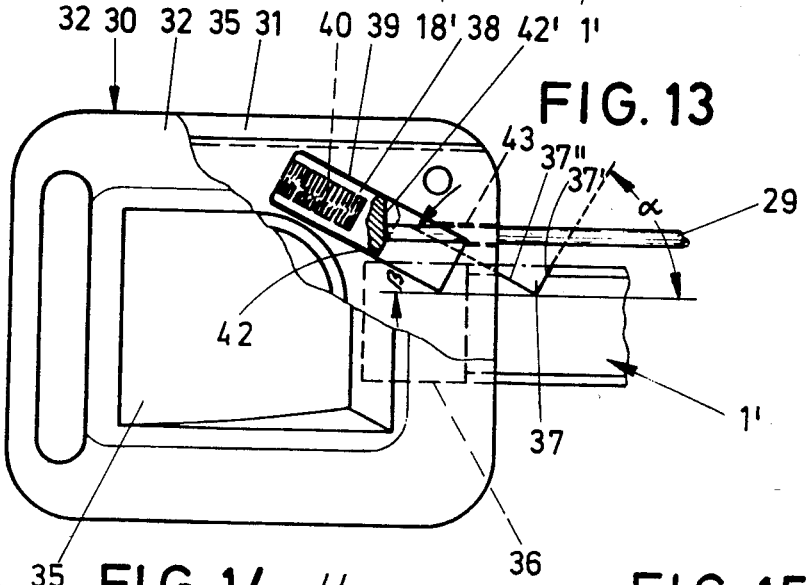
FIG. 13 is a view corresponding to FIG. 10, the bolt being displaced shifted into the release position.

The recess 37 cooperates with a slide bolt 38 which is displaceable obliquely to the channel 36. The bolt 38 is contained in a longitudinal groove 39 in the flashlight housing 31 which groove is directed obliquely into the channel. A compression spring 40, which engages into a bore 41 in the bottom of the bolt 38, urges the bolt in the direction towards the channel 36. FIG. 10 shows that the end surface 42 of the bolt extends at an acute angle to the direction of insertion of the bit. Its course is adapted to the alignment of the arm 37′ of the recess 37. From FIG. 13, in particular, it can be noted that the end surface 42 of the bolt is bent off at an angle to form a ridge. This bent-off portion bears the reference number 42′ and lies at a right angle to a tool-insertion opening 43. Opening 43 opens alongside the channel 36 in front of the end of the bolt so that the bolt can be definitely acted on by a tool 29.

In this embodiment, it is possible to push the key bit 1′ completely into the channel 36 without the use of a tool. In this case, the end 18″ of the key bit 1′ strikes the end surface 42 of the bolt 38, which surface 42 extends into the channel 36, and displaces the bolt 38 against action of spring 40. As soon as the angular recess 37 of the key bit 1' is flushly aligned with the bolt 38, the latter can advance back into the position shown in FIG. 10, producing a form-interlocking between the key bit 1' and the bolt 38. This form lock cannot be released by pulling on the key bit. Pulling on the key bit, rather, strengthens the form-interlocking. The pulling out of the key bit 1' requires a tool 29 which is introduced through the tool-insertion opening 43 and strikes against the bent portion 42' of the bolt 38. The bolt can then be displaced into the position shown in FIG. 13, free and clear of recess 37. The key bit 1' can then be pulled out of the channel 36. The groove 39 is furthermore of such a dimension that the length of entrance of the bolt 38 into the channel 36 is appropriately limited.

Figure 14:
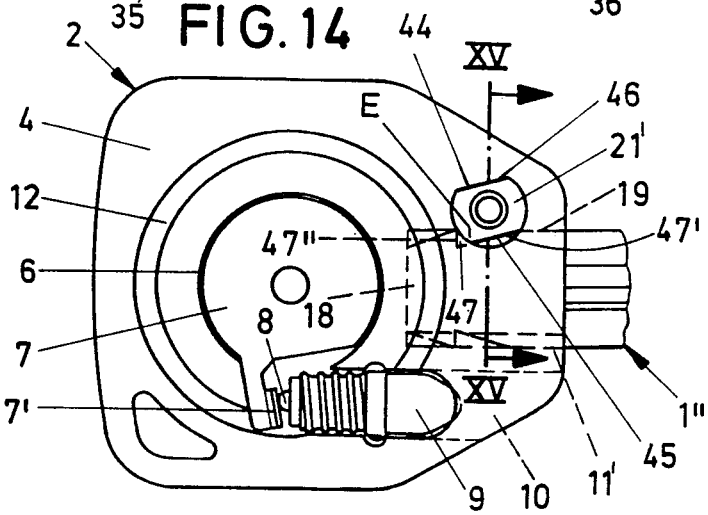
FIG. 14 is a view corresponding to FIG. 3, but showing the third embodiment.
Figure 15:
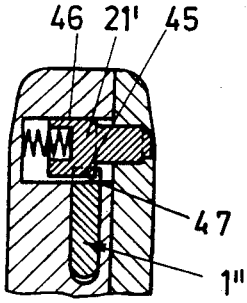
FIG. 15 is a section along the line XV—XV of FIG. 14.

The embodiment shown in FIGS. 14 and 15 corresponds essentially to the first embodiment. Accordingly, the same structural parts bear the same reference numbers. The mandrel 21' of this embodiment is of a cylindrical shape with flats 44, 45 on both sides. The receiving opening 46 for the mandrel 21' is flat on each side facing the channel 11' so that the mandrel 21' is not turnable. The flat 45 on the mandrel 21' extends parallel to the arm 47' of the angular recess 47 on the narrow side of the key bit 1'', The other arm 47' is aligned transverse to the direction of insertion of the key bit. In this way, a form-lock is formed between the angular recess 47 and the angular section E of the mandrel 21'. In this embodiment also, the insertion or removal of the key bit 1'' requires displacement of the mandrel 21' by a tool, in the same way as in the first embodiment.

Figure 16:
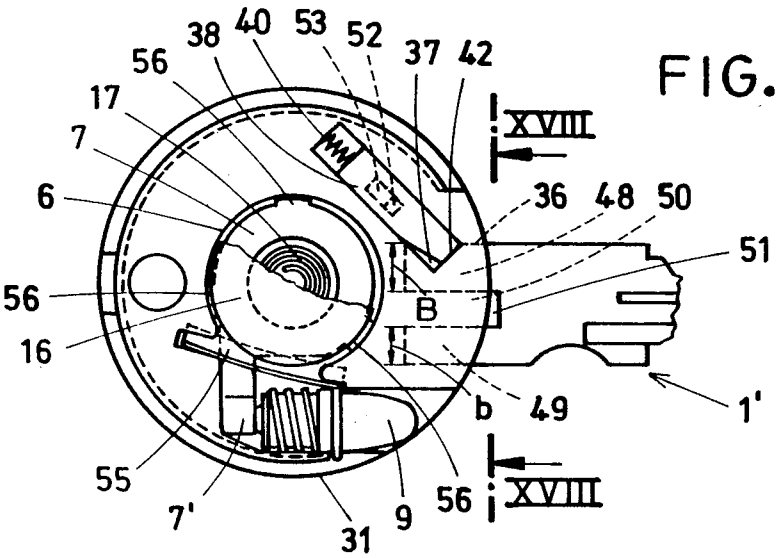
FIG. 16 in a partially broken away view of the fourth embodiment of the key with cap removed and round battery.
Figure 17:
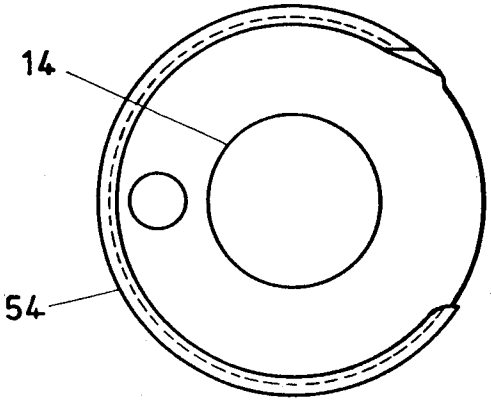
FIG. 17 is a view of the cap from the inside.

The fourth embodiment is more closely related, in the development of the insertion-catch attachment, to the basic structural elements of the second embodiment (FIGS. 8–13). However, the flashlight housing 31 is now of disk shape. The key bit 1' extends radially. As can be noted from FIG. 16, the insertion end of the key bit 1' is developed as a fork. The fork tines are designated 48 and 49 and form a fork opening 5' therebetween. The channel 36 of the flashlight housing 31 which receives the insertion end of the key bit 1' forms a rib 50 which enters in form-interlocking manner into the fork opening 51. The channel takes into account the corresponding cross-sectional size of the fork tines 48, 49.

As a result of the rib 50 which extends into the fork opening 51, two further support surfaces which lie in the direction of insertion of the key bit 1' are created. The bottom surface of the fork opening 51, which surface lies transverse to the direction of insertion, can abut, limited by a stop, against the corresponding end edge of the flashlight housing (not shown in the drawing) so that a third stop surface is present in addition to the stop surfaces formed by the bottom of the channel 36 lying in front of the ends of the fork tines 48, 49.

In this case also, in the same manner as in the embodiment described above, the recess 37 cooperates with a bolt 38 which is displaceable obliquely to the channel 36, the bolt enters under spring load in locking fashion into the recess 37 on the outer narrow edge of the fork tine 48. Insofar as necessary for understanding, the reference numbers have been applied by analogy. The removal of the key bit 1' in this case in not effected by the use of a tool 29 but by means of an actuating device 52 which protrudes slightly from the bottom surface of the flashlight housing 31 and is therefore freely accessible (see FIG. 18). The actuating device 52 comprises a transverse pin which is coupled with the bolt 38, the pin passing through a slot 53 lying in the direction of displacement of the bolt and being adapted to be displaced, for instance, by one's fingernail.

The fork tine 48, which has the recess 37, is of greater width B than the width b of the other tine 49. Accordingly, on the one hand, the loss of material due to the notch 37 is compensated for; on the other hand, however, correct fool-proof insertion is assured so that the fork tine which bears the place of detent locking can be introduced only in the correct position.

In a manner similar to the first embodiment (FIG. 7), the flashlight housing 31 is thicker than a corresponding clip-on cap 54. In the central opening 14 of cap 54, which opening passes through the cap, the actuating button, which grips in cap-like manner over the round battery 16, is guided with stop limitation.

Figure 18:
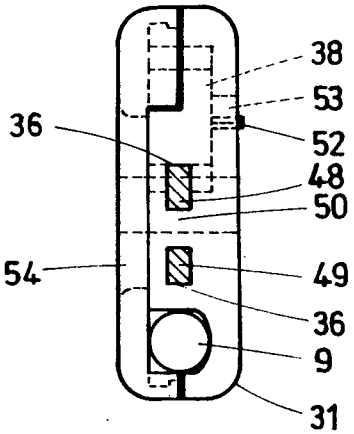
FIG. 18 is a section along line XVIII—XVIII of FIG. 16.

The region of the clip-on cap 54, on the side facing the key bit, is so shaped that it passes in the form of a bridge over the relatively thick-walled insertion region for the forked bit 1' (see FIG. 18). The edge of the cap is cut back in this region to the height of the inner side of the cap. The thickening of the flashlight housing 31 which extends into this bridge-shaped cut-out forms a stop to prevent turning of the cap 54.

Also in this embodiment, a cup-shaped recess 6 extends from the broad surface of the flashlight housing 31 which faces the cap 54. On the bottom of said recess there is the current-conductive contact plate 7 with contact lug 7' pointing in the direction of the bulb 9. The electric circuit is closed by a tongue 55 which is also conductive and is tangent to the edge of the round battery 16 and has spring resiliency in a transverse direction. Thus, it is merely necessary to press the round battery, which battery is moved by a conical spring 17, in the direction towards the bottom of the housing so that the central contact of the round battery contacts the contact plate 7. No conductive bridge is present between the spring and the central contact.

For an arrangement of the contact plate 7 which is favorable for assembly and assures the correct plate position, the contact plate is provided on its edge with a plurality of claws 56 arrranged substantially the same distance apart, claws digging into the cylindrical wall of the recess 6, thus securing the plate in proper position.

All new features mentioned in the specification and shown in the drawing are essential to the invention, even if they are not expressly set forth in the claims.

I claim:

1. In a key with a key bit and a handle, an end of the key bit extending in form-interlocked manner into a channel in the handle, the channel being directed towards a narrow side of the handle, the improvement comprising means for a disengageable insertion detent locking between said bit and handle, said means for detent locking comprises a mandrel, and spring means for displacing said mandrel in a direction transverse of the handle, said mandrel having an actuation surface exposed on a wide side of the handle, said key bit defining a recess extending from a narrow side of the key bit, a portion of the periphery of said mandrel form-interlocking into said recess.

2. The key according to claim 1, wherein said actuating surface is countersunk in said wide side of the handle and is smaller in cross-section than the cross-section of said portion of the mandrel form-interlocking in said recess.

3. In a key with a key bit and a handle, an end of the key bit extending in form-interlocked manner into a channel in the handle, the channel being directed towards a narrow side of the handle, the improvement comprising means for a disengageable insertion detent locking between said bit and handle, said means for detent locking comprises a narrow side of the key bit forming a recess, said recess being formed as an angular recess, a bolt which is displaceably mounted in said handle obliquely to said channel, said bolt having an end surface extending at an acute relative angle to the longitudinal direction of said channel, spring means for displacing said bolt such that said bolt including said end surface form-interlocks into said recess, and another end surface of said bolt forming substantially a V shape with said first-mentioned end surface.

4. The key according to claim 3, further comprising a tool-insertion opening defined in said handle alongside the channel, said opening opens in front of said another end surface of the bolt.

5. The key according to claim 1, wherein said portion of the periphery of said mandrel is of cylindrical shape.

6. The key according to claim 1, wherein said portion of the periphery of said mandrel is formed as an angular section of the mandrel.

7. In a key with a key bit and a handle, an end of the key bit extending in form-interlocked manner into a channel in the handle, the channel being directed towards a narrow side of the handle, the improvement comprising means for a disengageable insertion detent locking between said bit and handle, said handle further comprises a housing, said housing has a rib dividing said channel, said end of said key bit is an insertion end inserted in said channel, said insertion end has two tines spaced apart defining a fork opening therebetween, and said rib engaging between said tines into said fork opening.

8. The key according to claim 7, wherein said handle further comprises a cap engaging said housing, and wherein said housing has an insertion region adjacent said channel for the forked bit, and an edge of the cap extends over the insertion region forming a bridge.

9. The key according to claim 7, wherein one of said fork tines of the insertion end defines a recess forming a cooperating part of said insertion detent locking means, and said one tine has a larger width than the other of said fork tines.

10. The key according to claim 7, wherein said housing is of flattened shape.

11. The key according to claim 7, wherein said divided channel is substantially complementary to said two tines.

12. The key according to claim 9, wherein said divided channel is substantially complementary to said two tines.

13. The key according to claim 9, wherein said means for detent locking comprises a narrow side of said one tine of the key bit forming said recess, said recess being formed as an angular recess, a bolt which is displaceably mounted in said handle obliquely to said channel, said bolt having an end surface extending at an acute relative angle to the longitudinal direction of said channel, spring means for displacing said bolt such that said bolt including said end surface form-interlocks into said recesses.

14. The key according to claim 9, wherein said means for detent locking comprises a bolt which is displaceably mounted in said handle, said bolt having an end surface, spring means for displacing said bolt such that said bolt including said end surface form-interlocks into said recesses.

15. The key according to claim 9, wherein one of said fork tines of the insertion end defines a recess forming a cooperating part of said insertion detent locking means, and said means for detent locking comprises a bolt which is displaceably mounted in said handle, said bolt having an end surface, spring means for displacing said bolt such that said bolt including said end surface form-interlocks into said recess.

16. The key according to claim 7, wherein said housing is a flashlight housing, flashlight means mounted in said housing for emitting light directed substantially in a same direction as the key bit extends from said housing.

17. The key according to claim 7, wherein said channel together with said rib have four longitudinal narrow sides, said sides abut respective longitudinal narrow sides of said two tines forming a four longitudinal narrow side support for the key bit in said channel.

18. The key according to claim 7, wherein said rib engages in form-interlocking manner between said tines in said fork opening.

19. The key according to claim 7, wherein said means for detent locking is located on a narrow side of the key bit.

* * * * *